US010434361B2

(12) United States Patent
Dolcetti

(10) Patent No.: US 10,434,361 B2
(45) Date of Patent: Oct. 8, 2019

(54) EXERCISE WEIGHTS

(71) Applicant: Joseph Cleary Dolcetti, Kuala Lumpur (MY)

(72) Inventor: Joseph Cleary Dolcetti, Kuala Lumpur (MY)

( * ) Notice: Subject to any disclaimer, the term of this patent is extended or adjusted under 35 U.S.C. 154(b) by 0 days.

(21) Appl. No.: 15/103,587

(22) PCT Filed: Jul. 4, 2014

(86) PCT No.: PCT/MY2014/000204
§ 371 (c)(1),
(2) Date: Jun. 10, 2016

(87) PCT Pub. No.: WO2015/088323
PCT Pub. Date: Jun. 18, 2015

(65) Prior Publication Data

US 2016/0310778 A1 Oct. 27, 2016

(30) Foreign Application Priority Data

Dec. 10, 2013 (MY) ..... PI 2013702405

(51) Int. Cl.
*A63B 21/065* (2006.01)

(52) U.S. Cl.
CPC ..... *A63B 21/065* (2013.01); *A63B 2209/10* (2013.01)

(58) Field of Classification Search
CPC ..... A63B 21/06–068
(Continued)

(56) References Cited

U.S. PATENT DOCUMENTS 4,407,497 A * 10/1983 Gracie ..... A63B 21/065
128/DIG. 15
5,140,995 A * 8/1992 Uhl ..... A41D 13/0531
128/846

(Continued)

FOREIGN PATENT DOCUMENTS

| | | |
|---|---|---|
| WO | 2006124133 | 11/2006 |
| WO | 2011096793 | 8/2011 |
| WO | 2012168698 | 12/2012 |

OTHER PUBLICATIONS

International Preliminary Report on Patentability dated Jun. 14, 2016.

(Continued)

*Primary Examiner* — Garrett K Atkinson
(74) *Attorney, Agent, or Firm* — Preston Smirman; Smirman IP Law, PLLC

(57) ABSTRACT

An exercise weight for attachment to a partial or complete body suit having an outer surface comprising one part of a Velcro type fastening comprises a generally triangular pouch having a convex configuration at each end and formed of a resilient material that on one side of the pouch has its outer surface formed at least partially of the other part of the fastener, and a plurality of generally flat weight elements in the pouch in an array that conforms to the shape of the pouch and is of such size that it fits snugly within the pouch while being free to flex, the array of weight elements being in two equal rows about the axis of the pouch, the elements being of gradually decreasing size from the wide end of the pouch to the narrower end.

9 Claims, 7 Drawing Sheets

(58) Field of Classification Search
USPC ..... 482/100–109
See application file for complete search history.

(56) References Cited

U.S. PATENT DOCUMENTS

| | | | | |
|---|---|---|---|---|
| 5,586,561 | A * | 12/1996 | Archer, III | A41D 13/0153 128/846 |
| 6,427,695 | B1 * | 8/2002 | Zanetti | A41D 13/0531 128/846 |
| 6,687,920 | B2 * | 2/2004 | Berns | A41D 13/0531 2/467 |
| 6,852,087 | B1 * | 2/2005 | Dainese | A41D 13/0153 128/846 |
| 7,329,230 | B2 * | 2/2008 | Mazzarolo | A41D 13/0531 128/846 |
| 8,037,549 | B2 * | 10/2011 | Saur | A41D 19/01582 2/455 |
| 9,232,825 | B2 * | 1/2016 | Bencini | A41D 13/015 |
| 9,521,870 | B2 * | 12/2016 | Turner | A41D 13/0562 |
| 2006/0046913 | A1 * | 3/2006 | Squittieri | A63B 21/065 482/124 |
| 2010/0122404 | A1 * | 5/2010 | Bowlus | A41D 13/0531 2/467 |
| 2013/0000021 | A1 * | 1/2013 | Dolcetti | A63B 21/065 2/455 |
| 2016/0113339 | A1 * | 4/2016 | Dolcetti | A41D 31/0016 2/69 |
| 2016/0256727 | A1 * | 9/2016 | Miklosi | A63B 23/02 |

OTHER PUBLICATIONS

Written Opinion of the International Searching Authority dated Jan. 28, 2015.
International Search Report dated Feb. 10, 2015.

* cited by examiner

EXERCISE WEIGHTS

CROSS-REFERENCE TO RELATED APPLICATION

The instant application is a national phase of PCT International Patent Application Serial No. PCT/MY2014/000204 filed Jul. 4, 2014, and claims priority to Malaysian Patent Application Serial No. PI 2013702405, filed Dec. 10, 2013, the entire specifications of both of which are expressly incorporated herein by reference.

This invention relates to exercise weights and more particularly to an exercise weights that can be attached to a partial or complete body suit.

BACKGROUND TO THE INVENTION

Weight training has in recent times tended to move away from the use of heavy equipment such as dumbbells and barbells and turned towards lighter weights. This is primarily because by using these lighter weights the training can be directed towards treating more specific muscles or muscle groups.

Various ways of using these lighter weights have developed, mainly depending on attaching the weights on or in partial or complete body suits. For convenience in this specification both types of suit will be referred to as body suits.

Initially, the body suits were merely provided with spring clips in various places and weights were attached as desired by the user. The disadvantage of this was that the weights would swing which was uncomfortable and disconcerting.

Following this body suits with pockets for holding weights were produced but the number of pockets on a single garment is limited and the suits were not universally useful for users of different shape and body size.

The next move was to produce a body suit with a Velcro type surface and produce weights and pouches to hold them with a corresponding Velcro type surface. This got over the problems of the previous attempts but was still not a total solution since the rigidity of the weights meant that the weights still could not be positioned in every possible position and orientation on the suit.

SUMMARY OF THE INVENTION

This invention provides a solution to these problems.

According to the invention, an exercise weight for attachment to a partial or complete body suit having an outer surface comprising one part of a Velcro type fastening comprises a generally triangular pouch having a convex configuration at each end and formed of a resilient material that on one side of the pouch has its outer surface formed at least partially of the other part of the fastener, and a plurality of generally flat weight elements in the pouch in an array that conforms to the shape of the pouch and is of such size that it fits snugly within the pouch while being free to flex, the array of weight elements being in two equal rows about the axis of the pouch, the elements being of gradually decreasing size from the wide end of the pouch to the narrower end.

The pouch is preferably made from neoprene on its inside surface and may have other layers of flexible materials.

The edges of the pouch preferably extend beyond the limits of the array of weight elements and are firmly stuck together to leave a rim area which can be grasped to separate the weight from the suit Preferably, the Velcro type material does not extend over the entire surface of its side of the pouch but is only applied around an edge portion to ensure that the weight is not too firmly attached to the suit.

The Velcro type material that is preferably used for attachment of the weights is preferably injection mould Velcro since this material has a multitude of micro hooks and eyes so that it is long lasting and less of the material is required for a firm bond. It is, moreover, very much smoother to the touch.

The weight elements may be made of any material of sufficiently high density that the weights are not too large but are preferably formed of stainless steel, optionally with a protective surface coating.

The edges of the weight elements may be planar but in this case the elements will be loosely held within the pouch to allow flexing. Therefore, all the edges are preferably curved. The curvature of the contacting edges may be such as to give concave/convex contact but preferably they are all concave so that at all points of contact are point contact since this will allow the greatest flexibility for the weights.

The edges of the contacting planar surfaces of at least the upper rows of weight elements are preferably curved, except along the axis, so that the adjacent rows of elements are nested one within the curve of the next larger.

The weight elements may be attached to at least one surface of the pouch.

The exercise weights may be produced in a variety of weights, 50, 100 and 200 grams being a reasonable choice.

DESCRIPTION OF PREFERRED EMBODIMENT

The invention will now be described in greater detail, by way of example, with reference to the accompanying drawings in which FIG. 1 is an exploded view of a weight, in accordance with one embodiment of the present invention.

Figure 6:
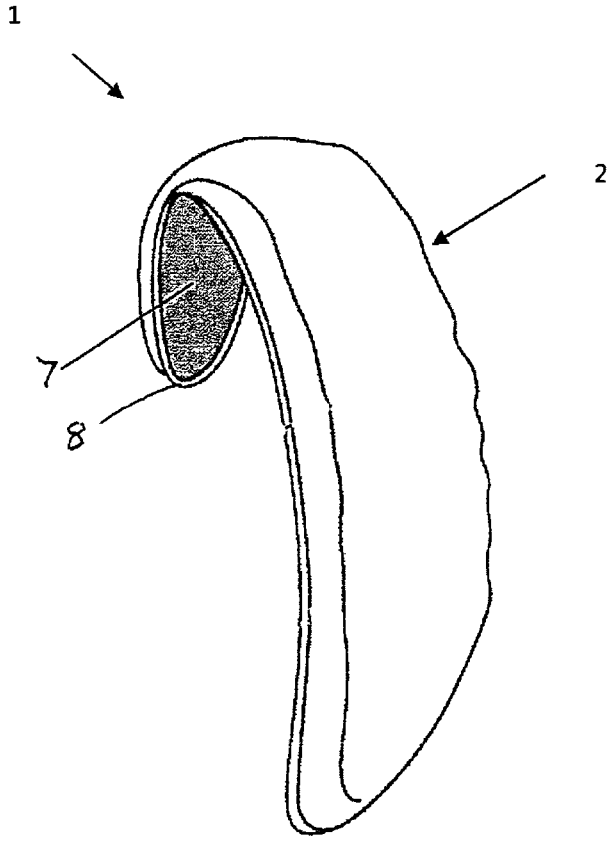
FIG. 6 is a perspective view of the weight from its neoprene side.
Figure 7:
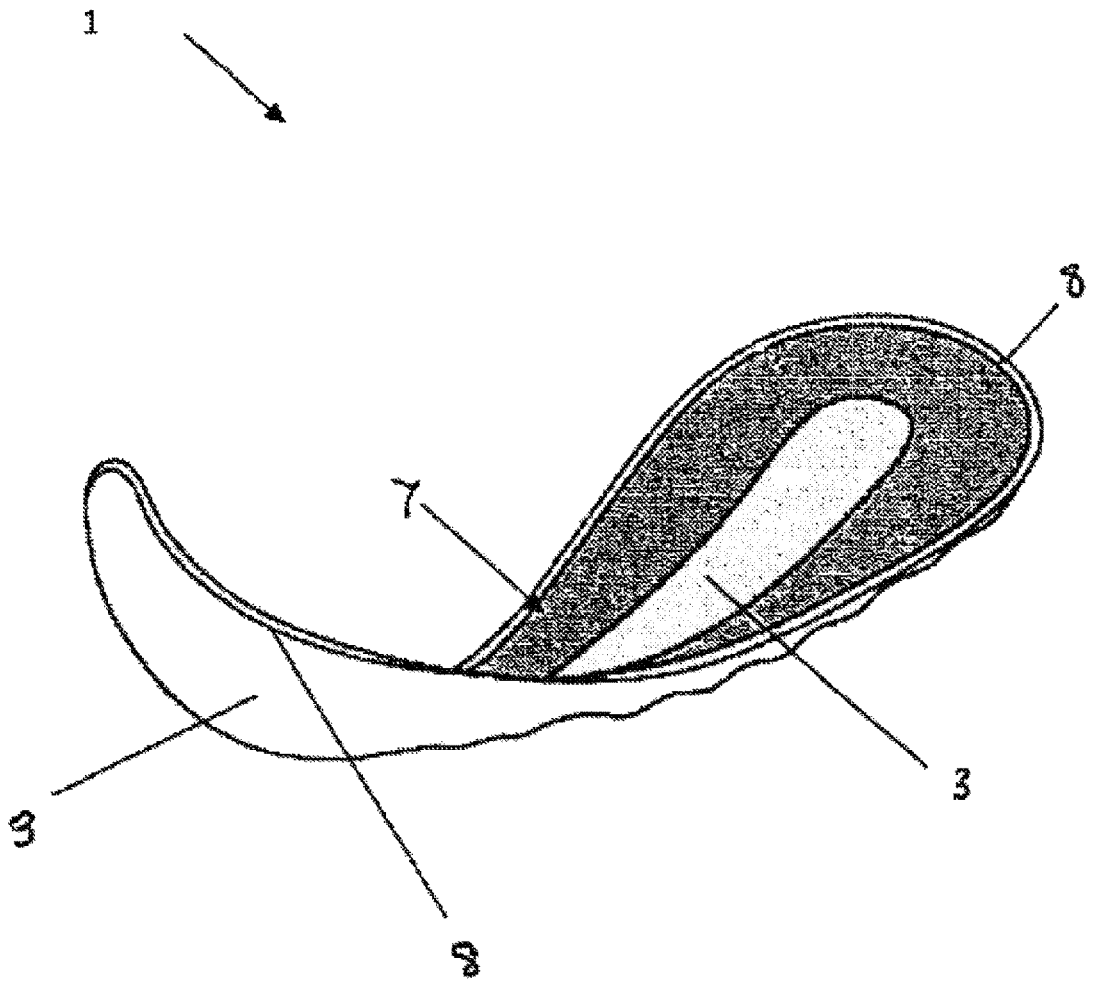
FIG. 7 is a perspective view of the weight from its Velcro side.

As shown in the drawings, the training weight 1 comprises a pouch 2 consisting of a first neoprene layer 3, a pliable layer 4 and a second neoprene layer 5 having a border 6 of injection mould Velcro 7, shown in FIG. 7. As shown in FIGS. 6 and 7, the edges of neoprene layers 3 and 5 are bonded together to form a rim 8 wide enough to be grasped and lifted to separate the weight 1 from a second piece of Velcro on a body suit.

The pouch 2 is of generally isosceles triangular configuration having convex portions 9 and 10 at its oppose ends.

Figure 1:
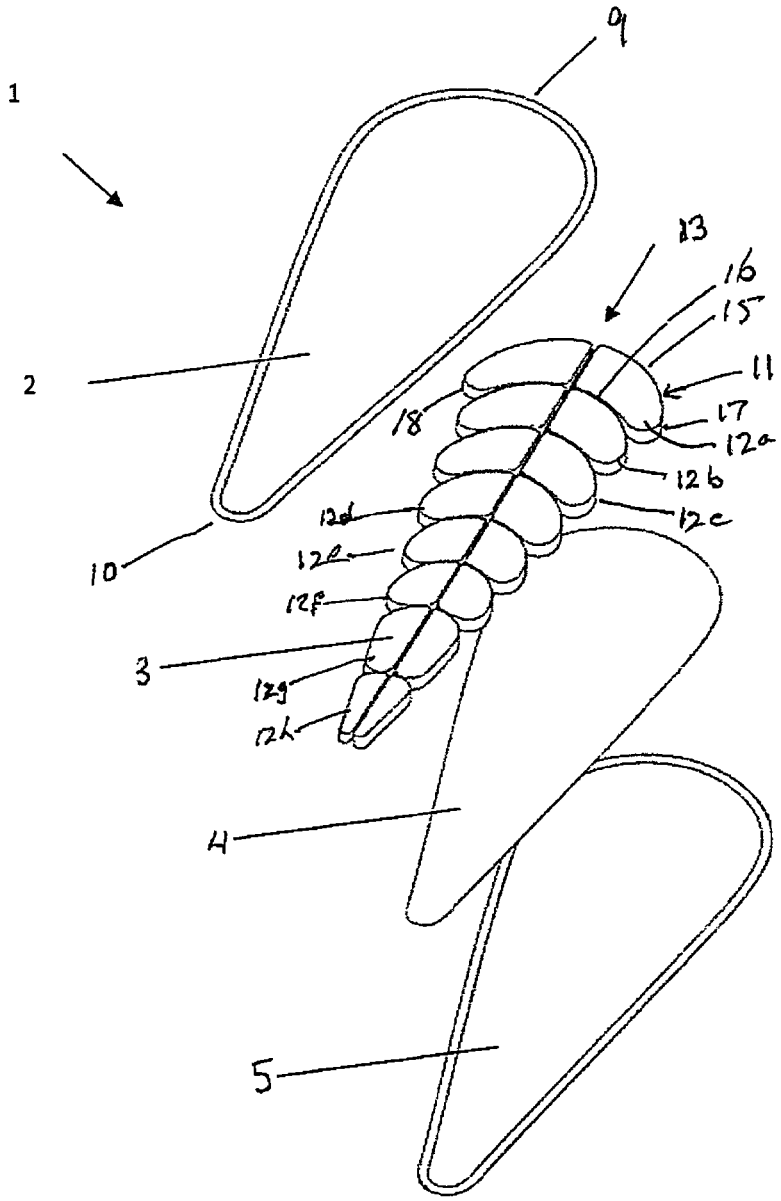
Figure 2:
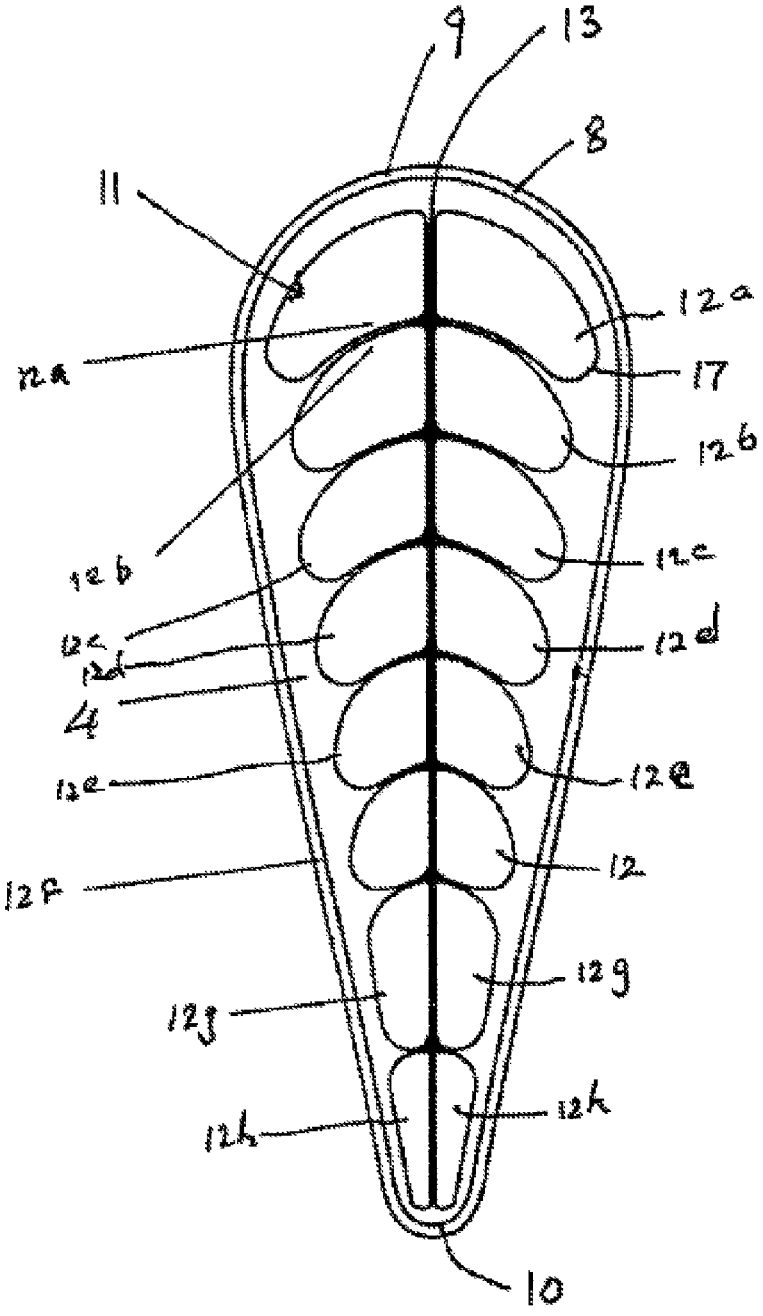
FIG. 2 is a plan view of the weight shown in FIG. 1 with one neoprene layer removed
Figure 3:
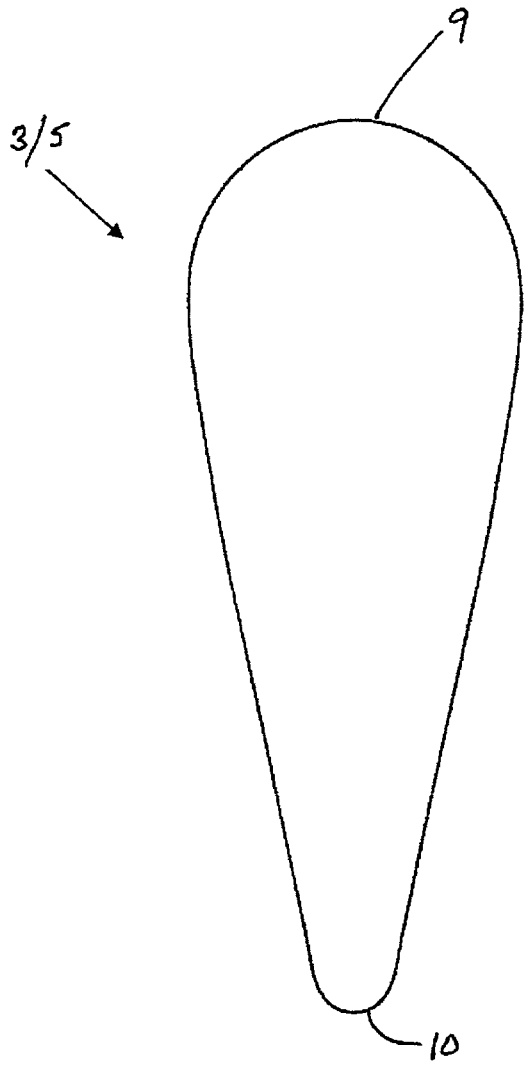
FIG. 3 is a plan view of the neoprene layer of the weight shown in claim 1
Figure 4:
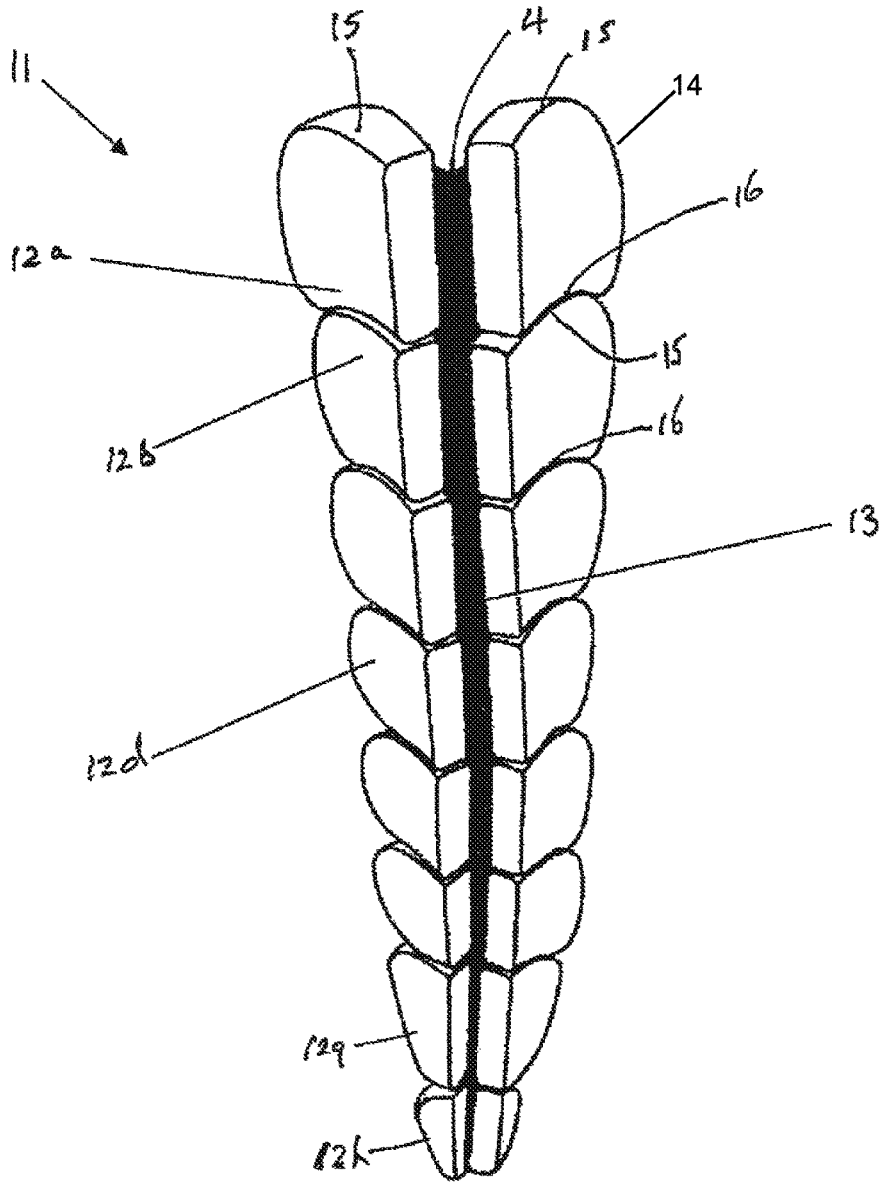
FIG. 4 is a view showing how the array of weight elements shown in FIG. 1 flexes about its axis
Figure 5:
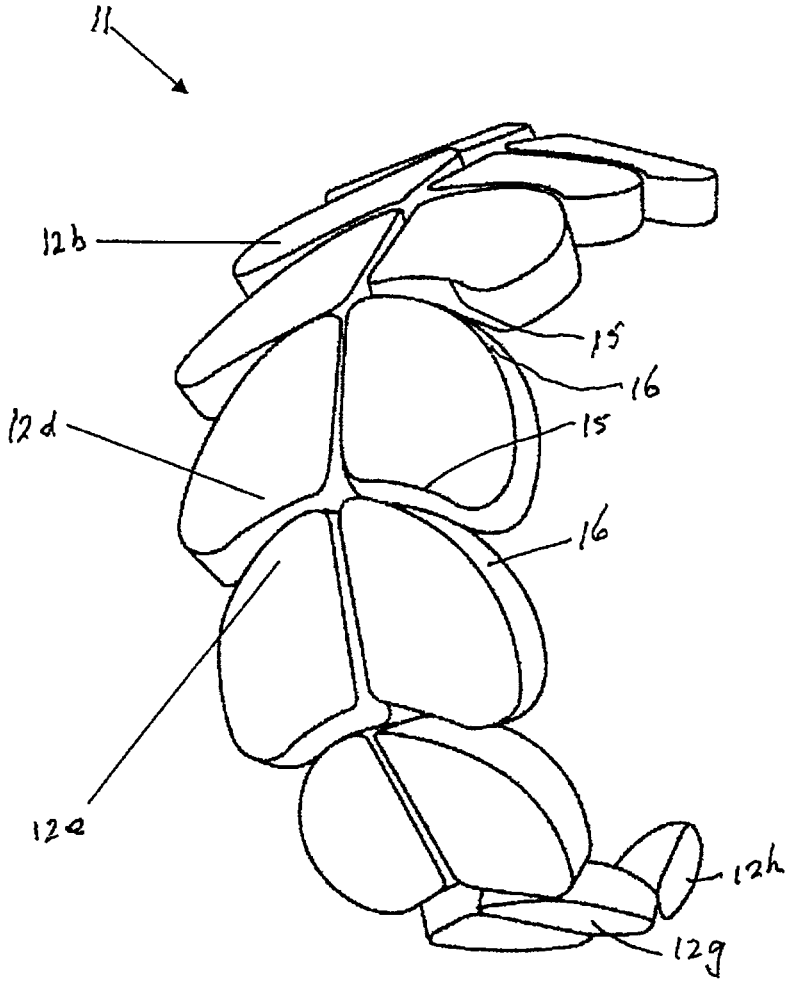
FIG. 5 is a view showing how the array of weight element shown in FIG. 1 flexes parallel to its axis

Within pouch 2 and mounted on pliable layer 4 is an array 11 of steel weight elements 12 having dimensions substantially sufficient to fill pouch 9. Array 11 is of tapering configuration and is symmetrical about its axis 13. Array 11 in the embodiment shown comprises, from its wider end 14, six rows of arcuate elements 12*a* to 12*f* and two rows of elongate elements 12*g* and 12 *h*. In plan view, as shown in FIG. 3, elements 12*a* to 12*f* have upper and lower curved walls 15 and 16, respectively, and curved portions 17 and 18, respectively, connecting walls 15 and 16. Walls 15 also have a concave curved surface, not shown, and walls 16 have a convex curved surface, not shown. The curves on adjacent elements 12 cooperate to allow the elements to rotate relative to each other. Elements 12*g* and 12*h* also have cooperating concave and convex curved surfaces. Along the axis 13 of the array 11 the elements 12 are not joined to allow flexure about axis 13.

The invention claimed is:

1. An exercise weight for attachment to a partial or complete body suit having an outer surface comprising one part of a hook and loop type fastening system, comprising:

a pouch formed of a resilient material and having a generally triangular shape with a convex wide end that tapers to an opposing convex narrow end, one side of the pouch having an outer surface formed at least partially of a corresponding second part of the hook and loop type fastening system; and a plurality of weight elements disposed in the pouch and arranged in an array that conforms to the shape of the pouch, the array of weight elements being in two equal rows about an axis of the pouch, the weight elements being of gradually decreasing size from the wide end of the pouch to the narrower end thereof, the weight elements being generally flat and configured to permit the pouch to flex about and along the axis.

2. The exercise weight according to claim 1, wherein the pouch is made from neoprene on an inside surface thereof and, optionally, includes other layers of flexible materials.

3. The exercise weight according to claim 1, wherein edges of the pouch extend beyond any limits of the array of weight elements and are firmly stuck together to provide a rim area configured to be grasped to separate the weight from the suit.

4. The exercise weight according to claim 1, wherein a material forming the hook and loop type fastening system does not extend over an entire surface of a side of the pouch, but is only around an edge portion thereof.

5. The exercise weight according to claim 1, wherein a material forming the hook and loop type fastening system is formed by injection molding.

6. The exercise weight according to claim 1, wherein the weight elements are formed of stainless steel.

7. The exercise weight according to claim 1, wherein a curvature of contacting edges of the weight elements are such as to give concave/convex contact therebetween.

8. The exercise weight according to claim 7, wherein the edges of contacting planar surfaces of at least an upper row of the weight elements are curved, except along the axis thereof, so that adjacent rows of the weight elements are nested one within a curve of a next larger weight element.

9. The exercise weight according to claim 1, wherein the weight elements are attached to at least one surface of the pouch.

* * * * *